US006725884B2

(12) United States Patent
Vermeulen

(10) Patent No.: US 6,725,884 B2
(45) Date of Patent: Apr. 27, 2004

(54) YARN TIGHTENING ELEMENT FOR A TEXTILE MACHINE

(75) Inventor: Erik Vermeulen, Kortrijk (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 198 days.

(21) Appl. No.: 10/114,441

(22) Filed: Apr. 3, 2002

(65) Prior Publication Data

US 2003/0188796 A1 Oct. 9, 2003

(30) Foreign Application Priority Data

Apr. 3, 2001 (BE) ..... 2001/0218

(51) Int. Cl.[7] ..... D03D 41/00; B65H 59/00

(52) U.S. Cl. ..... 139/102; 139/97; 139/103; 139/110; 139/109; 28/194; 242/131.1

(58) Field of Search ..... 139/97, 102, 103, 139/21, 450, 110, 109; 28/194; 242/131.1

(56) References Cited

U.S. PATENT DOCUMENTS

| | | | | |
|---|---|---|---|---|
| 791,404 A | * | 5/1905 | Cooper | 139/102 |
| 951,888 A | * | 3/1910 | Rhoades | 28/194 |
| 2,438,675 A | * | 3/1948 | Nicholas | 139/97 |
| 2,447,553 A | | 8/1948 | Barnes et al. | |
| 2,499,888 A | * | 3/1950 | Taylor | 226/195 |
| 2,702,934 A | * | 3/1955 | Frye | 28/194 |
| 2,797,468 A | * | 7/1957 | Brown | 28/194 |
| 3,201,956 A | * | 8/1965 | Liebrandt et al. | 66/125 R |
| 3,477,653 A | | 11/1969 | Peene | |
| 5,752,549 A | * | 5/1998 | Derudder et al. | 139/97 |
| 6,016,850 A | * | 1/2000 | Zimmermann et al. | 139/97 |
| 6,053,216 A | | 4/2000 | Debaes et al. | |
| 6,247,504 B1 | * | 6/2001 | Vermeulen | 139/97 |

FOREIGN PATENT DOCUMENTS

| | | |
|---|---|---|
| EP | 0742297 | 11/1996 |
| EP | 1077276 | 2/2001 |
| FR | 1549653 | 12/1968 |
| GB | 186169 | 9/1922 |

* cited by examiner

*Primary Examiner*—Danny Worrell
*Assistant Examiner*—Robert H. Muromoto, Jr.
(74) *Attorney, Agent, or Firm*—James Creighton Wray; Meera P. Narasimhan

(57) ABSTRACT

A yarn tightening element for a weaving machine, comprising a passage (16) for a yarn (15) and a contact means (2) to transmit a tightening force to a yarn (15) moving along through this passage, the passage (16) being not bordered on at least one side of the plane of movement of the yarn (15) or comprises a boundary (14) that is interrupted across its width, so that a part of the yarn (15) running through from that side of the plane of movement, via the interruption (17), can be made to co-operate with the contact means (2).

Figure 1:
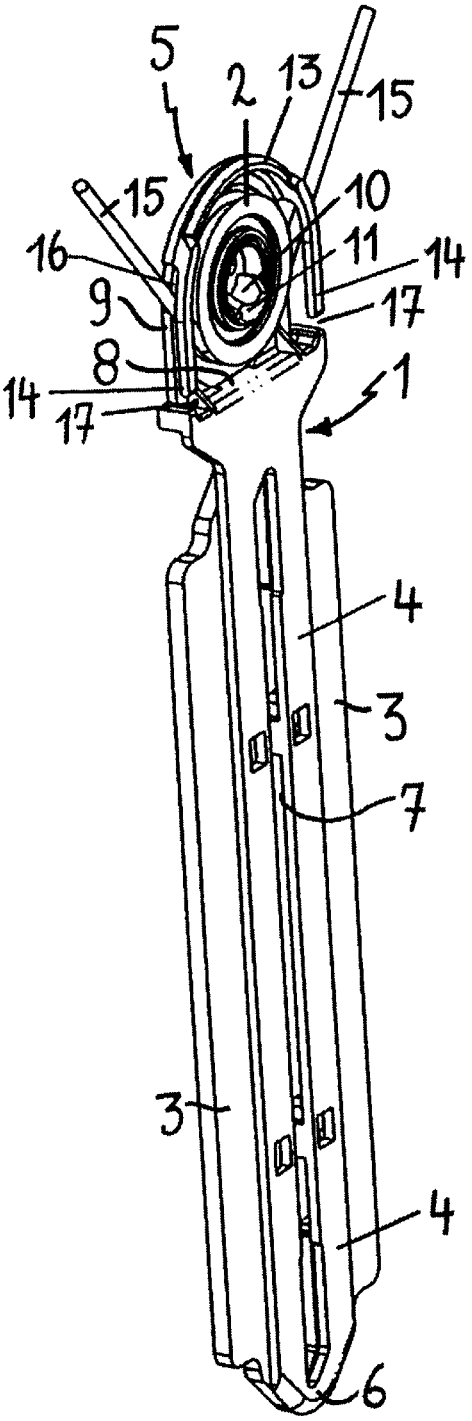

Said boundary is, for instance, formed by one or more fingers (14) directed downwards, while said interruption (17) of this boundary (14) is formed between the extremities of each finger (14) and a part (8) of the yarn tightening element.

Such a yarn tightening element can be placed on a yarn very easily and quickly by means of a hooking on movement and be removed again by means of an equally simple hooking off movement.

14 Claims, 1 Drawing Sheet

YARN TIGHTENING ELEMENT FOR A TEXTILE MACHINE

This invention relates to a yarn tightening element comprising a passage for a yarn and a contact part to transmit a tension to a yarn moving along through this passage.

Similar yarn tightening elements are generally known as plates for keeping tight and if required to withdraw warp yarns conducted to the weaving machine from respective bobbins on a weaving creel. Keeping these warp yarns tight is necessary in order to avoid them from getting mutually entangled. Slack warp yarns in the weaving zone should be absolutely avoided, because they will have a negative effect on the quality of weaving. The consequence might be an irregular formation of the pile. It should also be possible to withdraw from the weaving zone warp yarns taking up different positions in the shed during the weaving process in order to keep them tight.

A known type of weaving creel plates is described in the Belgian patent application n(09900475. These plates have an elongated body of a limited thickness, being the dimension in a direction transverse to the direction of movement of the warp yarns, when using the plate, so that they take up only limited space in the said direction. The contact means is carried out as a small cable wheel, rotatably mounted in the interspace between two flank plates.

Each plate co-operates with a respective warp yarn in order to tighten it. In doing so, the warp yarn extends through the passage below the small cable wheel and between the flank plates. With its small cable wheel, the plate rests on the warp yarn, and by its weight, exerts a downwards directed tractive force on that warp yarn, so that it is tightened and withdrawn if needed. This tractive force may be increased, for instance, to adapt it to certain modified properties (thickness, flexibility . . . ) of the warp yarns being used, by hanging an additional weight on the plate. For that purpose, the bottom part of the plate is provided with a hook.

However, these known plates have the following disadvantages. In order to put such a plate on a warp yarn in an operational position, the warp yarn should be cut through so that a free end can be pulled through the said passage between the flank plates, after which the free ends have to be tied together again. Also to remove such a plate from a warp yarn the warp yarn must be cut through and, after having removed the plate, the yarn ends have to be tied up again. Therefore installing or removing the plates is a very complicated and time-consuming job. Installing a yarn tightening device of a weaving creel, making use of a series of such plates, requires especially long installing times and hence it is rather expensive.

It is a purpose of this invention to provide a yarn tightening element, which comprises a passage and a contact means for transmitting a tightening force to a yarn moving through this passage, allowing to remedy the disadvantages mentioned above of the known yarn tightening elements and devices. It is at the same time likewise a purpose to provide a user-friendly yarn tightening element being of a simple design.

According to this invention, the purposes mentioned above are attained in an efficient manner by providing a yarn tightening element comprising a passage for a yarn and a contact means for transmitting a tightening force to a yarn moving through this passage, the passage of which—according to this invention—on at least one side of the plane of movement of the yarn comprises a boundary, interrupted across its width, so that via that interruption a part of the yarn moving through from that side of the plane of movement may be brought to co-operate with a contact element, and that the boundary (boundaries) of the said passage is/are carried out in such a manner that they extend up to alongside the yarn when using the yarn tightening element.

At the same time, the interruption should not necessarily run according to the direction of movement of the yarn and even should not necessarily have a rectilinear course. It is only important that the boundary has an interruption over the entire width through which a yarn may be brought within the boundary.

In this description and in the claims, by a "boundary interrupted across its width" is meant a boundary that has a continuous interruption across its entire width. The lateral direction is the direction that is almost parallel with the plane of movement of the yarn when using the yarn tightening element.

In this description and in the claims, by a "passage for a yarn" is meant each space through which a yarn may extend in co-operation with a yarn. This space may be not bordered or entirely or partly bordered on one or several sides or entirely bordered on all sides.

A similar yarn tightening element can be installed on a yarn in its operational position by an ordinary hooking on movement and be removed again by an equally simple hooking off movement. When doing so, the yarn running through will be made to co-operate with the contact means via the interruption in the boundary. To this end, the yarn should, of course, no longer be cut through. Hooking on and hooking off the yarn tightening elements can be done very quickly and is a very simple operation. Therefore, such a yarn tightening element is very user-friendly. Moreover, a yarn tightening element having the characteristics of this invention can be of a very simple design, so that it can be produced also very easily and cheap, for instance by means of parts made of synthetic material.

Because the boundary (boundaries) of the said passage extend up to along the yarn, when using the yarn tightening element, an optimum guidance of the yarn is obtained and an undesired lateral movement of the yarn tightening element with respect to the yarn is no longer possible, so that the contact element and the yarn are always kept in a position in which they co-operate.

In a preferred embodiment, the yarn tightening element comprises a boundary on both sides of the plane of movement of the yarn, whereas this boundary is interrupted across its entire width on at least one side of this plane of movement. A similar embodiment with a boundary on both sides of the yarn passage has the advantage that the boundary provides a guidance of the yarn and, among others, will assist to preserve the co-operation between the contact element and the yarn when using the yarn tightening element. If the contact element is carried out in the form of a small guiding wheel, the boundary on both sides will help to avoid the small wheel from running off the yarn.

An additional advantage of this boundary on both sides is that inconvenient oscillating movements of the yarn tightening element resting on the yarn will be avoided or reduced to a large extent. A similar yarn tightening element is particularly reliable.

Preferably, the said boundary is formed by one or more fingers directed downwards, whereas the said interruption of this boundary is formed between the extremities of each finger and a part of the yarn tightening element. In a particular embodiment, this boundary is formed by two such fingers, being kept separated from one another in the direction of movement of the yarn.

For the contact means, preferably a rotatable guiding wheel is provided, guaranteeing minimal friction of the yarn in the yarn passage of the yarn tightening element.

The yarn tightening element according to this invention may be provided for a device in which the tractive force is caused, entirely or partly, by a spring force, or any other force. However, an embodiment of the yarn tightening element, provided to exert the said tractive force by gravity, more particularly by the yarn tightening element's own weight is preferred. Such a device is indeed very simple and reliable.

Preferably, care is taken that the yarn tightening element comprises a weight element that is removable. So, the tension may be influenced in a very simple manner by replacing a first weight element by another weight element (having a different weight). In order that the yarn tightening element will require the smallest possible space in a direction at right angles to the plane of movement of the yarn, this removable weight element is carried out as a plate-shaped body. Because of the limited thickness of such a weight element, the warp yarn can run very closely next to one another and a great number of yarns may be provided beside one another at a useful width.

Preferably, the yarn tightening element comprises also a holder and a weight element additional to the said contact means, while both the weight element and the contact means are carried by the holder. In this manner, a very simple construction is obtained the parts of which (being very restricted in number anyway) are easily to produce and to assemble.

If the yarn tightening element is composed of parts that may be connected by hand without the help of tools, it is rather simple to assemble the yarn tightening elements. This may be done, for instance, on an automatic assembly line. In case dismantling can also occur by hand, replacing a part can be done very quickly without the use of any tools. Such a yarn tightening element is very user-friendly.

In a particularly preferred embodiment, the holder and the contact element are made of synthetic material, while the weight element is made of metal. Manufacturing parts of synthetic material can occur at very low production costs. Yet, by using metal for the weight element, a sufficiently heavy weight can be obtained at a relatively small volume. Moreover, metal has the advantage of a good electrical conductivity, so that the yarn tightening element can be used to realize an electric contact in one or more positions, for instance, to detect these positions and the corresponding yarn tension.

For instance, in order to realize such a contact, the yarn tightening element can be made with a recess, at least one edge of which is provided to make contact with a contact element of a detection device in a pre-determined position of the yarn tightening element.

Another disadvantage of the known plates described above is, that adapting its weight should occur by hanging weight unto the bottom part of the plate. Because of this, the height of the plate will increase, and consequently the useful height for moving up and down the plates will be reduced. Only weights of a limited height may be suspended from the plate. The heavier the weights are, the longer they are, so that a number of weights can no longer be used because they are becoming too long.

An additional purpose consists in providing a yarn tightening element having one or more characteristics of the present invention, but for which at the same time a number of weight elements are provided, that can be used irrespective of their weight.

This purpose is attained by providing a yarn tightening element according to this invention, where at least two weight elements of different weights have been provided, these weight elements having virtually the same height. The weight elements have a height (irrespective of their weight) that is adapted to the space available. Adapting the exerted tightening force has no longer any influence whatsoever on the height of the yarn tightening elements.

Similar weight elements may also be used with yarn tightening elements that are not carried out in accordance with this invention. Since, with these other (known) types of yarn tightening elements, the advantage mentioned above can also be obtained.

Preferably, the difference in weight of the weight elements is mainly caused by the fact that they have different dimensions in the direction running almost parallel with said plane of movement of the yarn in the operational position of the yarn tightening element. Since the available space is not only limited as to height, but also in a direction transverse to the direction of movement of the yarn, in order to be able to maintain a minimum distance between yarns running next to each other, so that also an increase in thickness of the weight elements is not desirable. The only direction where sufficient space is still available is the direction parallel with the plane of movement of the yarn. The difference in weight of the weight elements may be obtained by changing their dimensions in that direction (their width).

Moreover, the weight elements can be attached in such a manner that they extend along the other parts and therefore do not increase the height of the plate.

Of course, a number of parts for composing the yarn tightening element according to this invention are within the scope of the present invention. This is particularly true for a yarn tightening element with one or more additional weight elements having the above-mentioned characteristics, which are provided to modify the weight of the yarn tightening element.

Now, this invention will be further explained with the help of the following detailed description of a preferred yarn tightening plate according to this invention. The intention of this description is exclusively to give an explanatory example and to indicate further advantages and particulars of the present invention and may in no way be interpreted as a limitation of the scope of the present invention or of the patent rights claimed in the claims.

In this detailed description, reference is made by means of reference numbers to the attached drawings.

Figure 2:
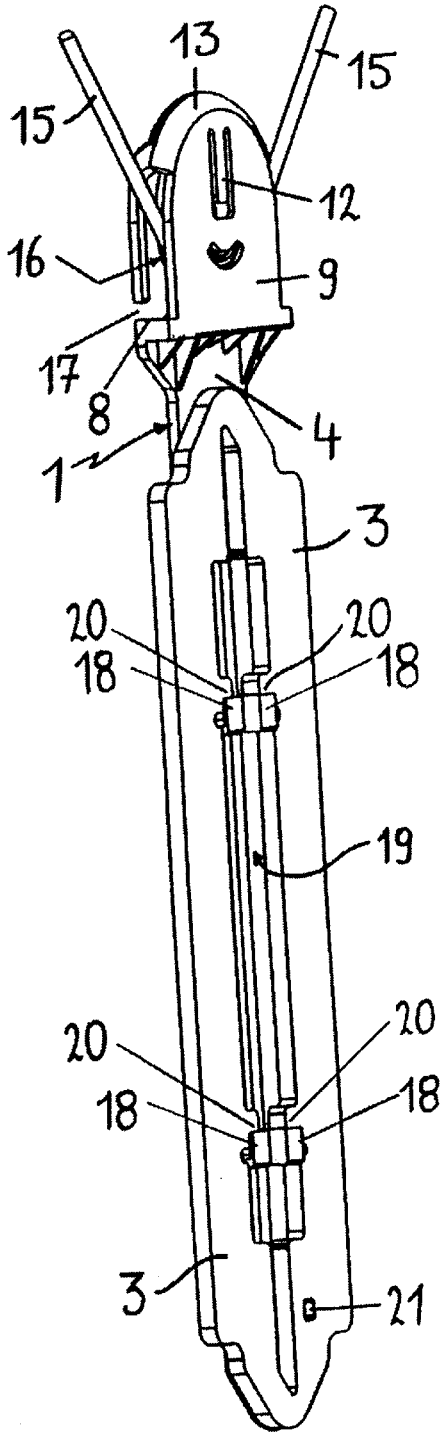

FIGS. 1 and 2 represent a perspective view of two opposite sides of a yarn tightening plate according to the present invention placed on a warp yarn.

The yarn tightening plate represented in the figures consists of three parts: a holder (1) which is made in one piece of synthetic material, a small guiding wheel (2) likewise made of synthetic material as a separate entity and a metal weight plate (3).

The holder (1) consists of an elongated body (4) with a uniform width and limited thickness that turns into a somewhat wider and thicker head part (5) and ends at the bottom in a rounded extremity (6). In the body (4) a central recess (7) is provided, extending vertically. This recess (7) has parallel vertical edges and both at the top and at the bottom a beveled terminal edge.

The head part (5) consists of a narrow horizontal part (8) on which a vertical wall part (9) is placed, extending in a plane running parallel with the plane of the body (4) and the holder (1), but shifted a little sideways with respect to it. In the center of the wall part (9) a curved edge (10) is provided extending horizontally and directed towards the plane of the body (2), having a semi-circular form, the concave side being directed upwards. On that semi-circular edge (10), an elastic wing (11), directed downwards, has been provided.

In this wall part (9) also a U-shaped recess is provided, because of which an elongated part of the wall (9) forms an elastic lip (12) attached to the wall on one side. Along the side directed towards the small guiding wheel (2) this lip (12) has a protrusion. The small guiding wheel (2) can be clipped onto the semi-circular edge (10). For that purpose the small wheel (2) is placed with the central circular opening over the semi-circular edge (10) and then pressed upwards, the elastic lip (12) being slightly bent away from the small wheel until the protrusion provided on the lip, finally clips into a lateral circular groove (not shown in the figures) of the small wheel and the lip (12) springs back. During its rotation, the small guiding wheel (2) is conducted around the semi-circular edge (10) by the protrusion situated in the groove. Along the other side (the side directed away from the wall part (9)) the small wheel (2) is kept in its place because a lateral displacement is prevented by the wing (11) mentioned above. Because of this clip-on connection, the small wheel (2) can be placed on the holder (1) easily and quickly.

At the top, the wall part (9) is semi-circular and has an upper arched edge (13) extending laterally up to above the small guiding wheel (2). Linked up to the two extremities of this arched edge (13) two fingers (14) directed downward are provided that extend parallel with one another in a plane of the body (4) to finish at a short distance above the level of the said horizontal part (8).

In this way a warp yarn (15) passing between the extremities of the fingers (14) and the horizontal part (8) can be brought below the small guiding wheel (2) and the yarn tightening plate can be hooked unto the warp yarn (15) and be hooked off again. The yarn passage (16) is bordered on one side by the vertical wall part (9) and on the other side by the fingers (14) extending downwards. At the bottom, this passage (16) is bordered by said horizontal part (8). Along the one side, the boundary is interrupted between the extremities of the fingers (14) and the horizontal part (8). In the figures, this interruption is indicated by the reference number 17. In its operational position, the plate rests with the small guiding wheel (2) on the warp yarn (15) and thus tightens it by its own weight.

The possibility to install or to remove a tightening device much quicker than before, by simply hooking on or hooking off the plates, makes these plates according to the present invention particularly user-friendly.

Because of the boundary on both sides, extending up to beside the small guiding wheel (2), this small wheel (2) will not run off the yarn (15) and the inconvenient oscillation of the plate is avoided.

On the opposite side of the holder (1), a respective pair of hooks (18) directed upwards is further provided on the body (2) on two different levels. The hooks (16) of each pair are situated on both sides of the recess (7) in order to carry the weight plate (3). Finally, a protrusion is formed on the wall of the body (2) that fits into a bore (21) in the weight plate (3).

The weight plate (3) made of metal is plate-shaped and has a recess (19) extending along the central vertical line of symmetry, the upper and lower end parts of which correspond with the form of the recess in the body (2). In the center the recess is wider and is provided with hook-shaped parts (20) in the direction of the central axis and formed in the plate-shaped material. With respect to shape and position, these hook-shaped parts (20) are such that they can hook into the hooks (18) of the holder (1).

Finally, there is another square bore (21) provided in the weight plate (3). If the weight plate (3), in its correct position, is hooked onto the holder (1), the said protrusion of the wall of the body (2) gets into this square bore (20).

To hook the weight plate (3) off the holder (1) the bottom part of the body (2) must be bent away from the weight plate (3) in order to remove the protrusion from the square bore (21). Then the weight plate (3) can be slid upwards with respect to the holder (1) until the hook-shaped parts (20) get free from the hooks (18) of the holder (1).

The upper and lower beveled terminal edges of the recess (19) in the weight plate are used at the same time to make contact with the electrodes that are provided to detect too high and/or too low a tension in the warp yarns (15).

Changing the weight of the plate simply occurs by replacing the weight plate (3) by another weight plate (3) having another weight. The difference in weight is obtained because the new weight plate (3) has other dimensions in the lateral direction. The height and the thickness of the weight plates (3) remain identical. Thus, the space available in height may be used maximally at each weight to move the plate up and down.

Because the plate only consists of three parts (1), (2), (9) two (1), (2) of which are made of synthetic material, a product is obtained that can be realized in a very simple and cheap manner. The simple installing and dismantling of these parts by the clip and hook on connections makes the products very well suitable for an automatic assembly line and will makes it extremely easy to replace parts.

What is claimed is:

1. Yarn tightening element comprising a passage (16) for a yarn (15) and a contact means (2) for transmitting a tightening force to a yarn (15) moving through this passage, characterized in that the passage (16) comprises a boundary (14) on at least one side of the plane of movement of the yarn, which is interrupted across its width, so that a part of the yarn (15) running through from that side of the plane of movement, can be made to co-operate with the contact element (2) and in that the boundary (boundaries) (9), (14) of said passage (16) is/are carried out in such a manner that they extend up to along the yarn (15) during the time the yarn tightening element is used.

2. Yarn tightening element according to claim 1 characterized in that the yarn tightening element comprises a boundary (9), (14) on both sides of the plane of movement of the yarn (15) and in that this boundary (9), (14) is interrupted across its width on at least one side of this plane of movement.

3. Yarn tightening element according to any one of the preceding claims, characterized in that said boundary is formed by one or more fingers (14) directed downwards and in that said interruption (17) of this boundary (14) is formed between the extremities of each finger (14) and a part (8) of the yarn tightening element.

4. Yarn tightening element, according to claim 3, characterized in that the boundary is formed by at least two fingers (14) being away from one another in the direction of the movement.

5. Yarn tightening element according to any one of the preceding claims, characterized in that the contact means is a rotatable guiding wheel (2).

6. Yarn tightening element according to any one of the preceding claims, characterized in that the yarn tightening element is provided to exert the said tightening force by its own weight.

7. Yarn tightening element according to any one of the preceding claims, characterized in that it comprises a removable weight element (3) carried out as a plate-shaped body.

8. Yarn tightening element according to any one of the preceding claims, characterized in that it comprises a holder (1) and a weight element (3) and in that both weight element (3) and contact means (2) are carried by the holder (1).

9. Yarn tightening element according to any one of the preceding claims, characterized in that the yarn tightening element is composed of parts (1), (2), (3) that may be connected to one another by hand and may be loosened again by hand.

10. Yarn tightening element, according to claim 8 or 9, characterized in that the holder (1) and the contact means (2) are made of synthetic material, whereas the weight element (3) is made of metal.

11. Yarn tightening element according to any one of the preceding claims, characterized in that the yarn tightening element comprises a recess (7), (19) at least one edge of which is provided to make contact with a contact element of a detecting device in a predetermined position of the yarn tightening element.

12. Yarn tightening element according to any one of the preceding claims, characterized in that at least two weight elements (3) are provided with a different weight and in that these weight elements (3) are practically of the same height.

13. Yarn tightening element, according to claim 12, characterized in that the difference in weight of the weight elements (3) is primarily caused because they have different dimensions in a direction, which, in the operational position of the yarn tightening element, runs practically parallel with the said plane of movement of the yarn (15).

14. Yarn tightening element according to any one of the preceding claims, characterized in that it comprises a weight element (3), that extends next to the other parts (1) of the yarn tightening element, so that the weight element (3) does not increase the height of the yarn tightening element.

* * * * *